US005586795A

United States Patent [19]

Sasaki

[11] Patent Number: 5,586,795

[45] Date of Patent: Dec. 24, 1996

[54] EMBEDDED-TYPE HANDLE ASSEMBLY

[75] Inventor: Shunji Sasaki, Tokyo, Japan

[73] Assignee: Takigen Manufacturing Co. Ltd., Tokyo, Japan

[21] Appl. No.: 521,015

[22] Filed: Aug. 30, 1995

Related U.S. Application Data

[63] Continuation of Ser. No. 191,811, Feb. 3, 1994, abandoned.

[30] Foreign Application Priority Data

Mar. 1, 1993 [JP] Japan ..... 5-013637 U

[51] Int. Cl.[6] ..... E05B 3/00

[52] U.S. Cl. ..... 292/336.3; 292/34; 292/DIG. 31

[58] Field of Search ..... 292/7, 34, 60, 292/66, 69, DIG. 31, 336.3

[56] References Cited

U.S. PATENT DOCUMENTS

| | | | |
|---|---|---|---|
| 499,971 | 6/1893 | Davis | 292/40 |
| 1,126,223 | 1/1915 | Johnson | 292/40 |
| 2,108,359 | 7/1935 | Accardi | 292/40 |
| 3,158,016 | 11/1964 | Fay | 292/40 |
| 3,751,949 | 8/1973 | Castle | 292/66 |
| 4,231,597 | 11/1980 | Pelcin | 292/164 |
| 4,387,917 | 6/1983 | Cocker | 292/40 |
| 4,892,338 | 1/1990 | Weinerman | 292/DIG. 31 |
| 4,911,487 | 3/1990 | Rachocki | 292/DIG. 31 |
| 4,951,486 | 8/1990 | Braun | 292/DIG. 31 |
| 4,989,907 | 2/1991 | Edmonds | 292/DIG. 31 |
| 5,042,853 | 8/1991 | Gleason | 292/DIG. 31 |
| 5,046,340 | 9/1991 | Weinerman | 292/DIG. 31 |
| 5,058,937 | 10/1991 | Miehe | 292/DIG. 31 |
| 5,127,686 | 7/1992 | Gleason | 292/DIG. 31 |

FOREIGN PATENT DOCUMENTS

| | | | |
|---|---|---|---|
| 470433 | 8/1937 | United Kingdom | 292/36 |

*Primary Examiner*—Steven N. Meyers
*Assistant Examiner*—Gary Estremsky
*Attorney, Agent, or Firm*—Martin Smolowitz

[57] ABSTRACT

An embedded-type handle assembly may have its lock bars arranged either horizontally or vertically. In the assembly: a shaft 9 is rotatably inserted in a cylindrical bearing portion 8 of a casing 1; a link plate 18 has a circular hole 16 through which the link plate 18 is mounted on the shaft 9 in an insertion manner; a lock bar 20 has its base-end portion connected with one end 19 of the link plate 18 through a pivot 27; a lock bar 23 has its base-end portion connected with the other end 22 of the link plate 18 through a pivot 28; the link plate 18 has a follower surface 25 in a side surface of the other end portion 22, the surface 25 being pushed by the operating-foot plate 5 of the handle 2; and, the link plate 18 has a follower projection 26 in a side surface of its intermediate portion, the projection 26 being pushed by the operating-foot plate 5 of the handle 2.

6 Claims, 7 Drawing Sheets

EMBEDDED-TYPE HANDLE ASSEMBLY

This application is a continuation of application Ser. No. 08/191,811, filed Feb. 3, 1994, now abandoned.

BACKGROUND OF THE INVENTION

1. Field of the Invention

The present invention relates to an embedded-type handle assembly for locking a door to a stationary frame element of an electrical equipment housing and the like.

2. Description of the Prior Art

In a conventional embedded-type handle assembly, when a handle is pulled out of a casing fixed to a door, a sliding plate is slidably driven by an operating-foot plate provided in a rear surface of an base-end portion of the handle, so that a pair of lock bars connected with the sliding plate through an interlocking mechanism constructed of cams and links are pulled toward the casing, whereby a latch element connected with a front end of each of the lock bars is disengaged from a socket member of a stationary frame element.

However, in the conventional handle assembly, since the sliding plate and the interlocking mechanism are mounted on the casing in only one specified arrangement, the lock bars are so specified as to be mounted either vertically or horizontally on the casing. Consequently, in order to fulfill a user's requirements, it is necessary to provide two kinds of the handle assemblies, one of which has its lock bars arranged horizontally, while the other of which has its lock bars arranged vertically. Since such conventional assemblies require corresponding two kinds of each metallic molds, costs for installation of metallic molds increase. In addition, a large inventory accumulation space is required for the conventional handle assembly.

SUMMARY OF THE INVENTION

It is an object of the present invention to provide an embedded-type handle assembly which may have its lock bars arranged either horizontally or vertically by simply modifying its part's arrangement, and, therefore enables the user to use the assembly in either arrangement of the lock bars.

The above object of the present invention is accomplished by providing:

an embedded-type handle assembly comprising:

a casing;

a handle having its base-end portion pivoted to side walls of the casing through a cross pivot so as to be received in the casing, the handle being provided with an operating-foot plate in a rear surface of the base-end portion, which plate projects from the rear surface to pass through a through-hole of a bottom wall of the casing which has its cylindrical bearing portion projected from a rear surface of the bottom wall;

a shaft rotatably inserted in the cylindrical bearing portion of the casing;

a spring for biasing the handle toward its embedded position within the casing;

a link plate provided with a circular hole through which the link plate is mounted on a front-end portion of the shaft in an insertion manner, the link plate being prevented from dropping out of the shaft;

a first lock bar having its base-end portion connected with one end portion of the link plate through a pivot;

a second lock bar having its base-end portion connected with the other end portion of the link plate through a pivot;

the link plate being provided with a follower surface in a side surface of the other end portion, the follower surface being pushed by the operating-foot plate of the handle; and the link plate being provided with a follower projection in a side surface of its intermediate portion, the follower projection being pushed by the operating-foot plate of the handle.

DESCRIPTION OF THE PREFERRED EMBODIMENTS

Figure 1:
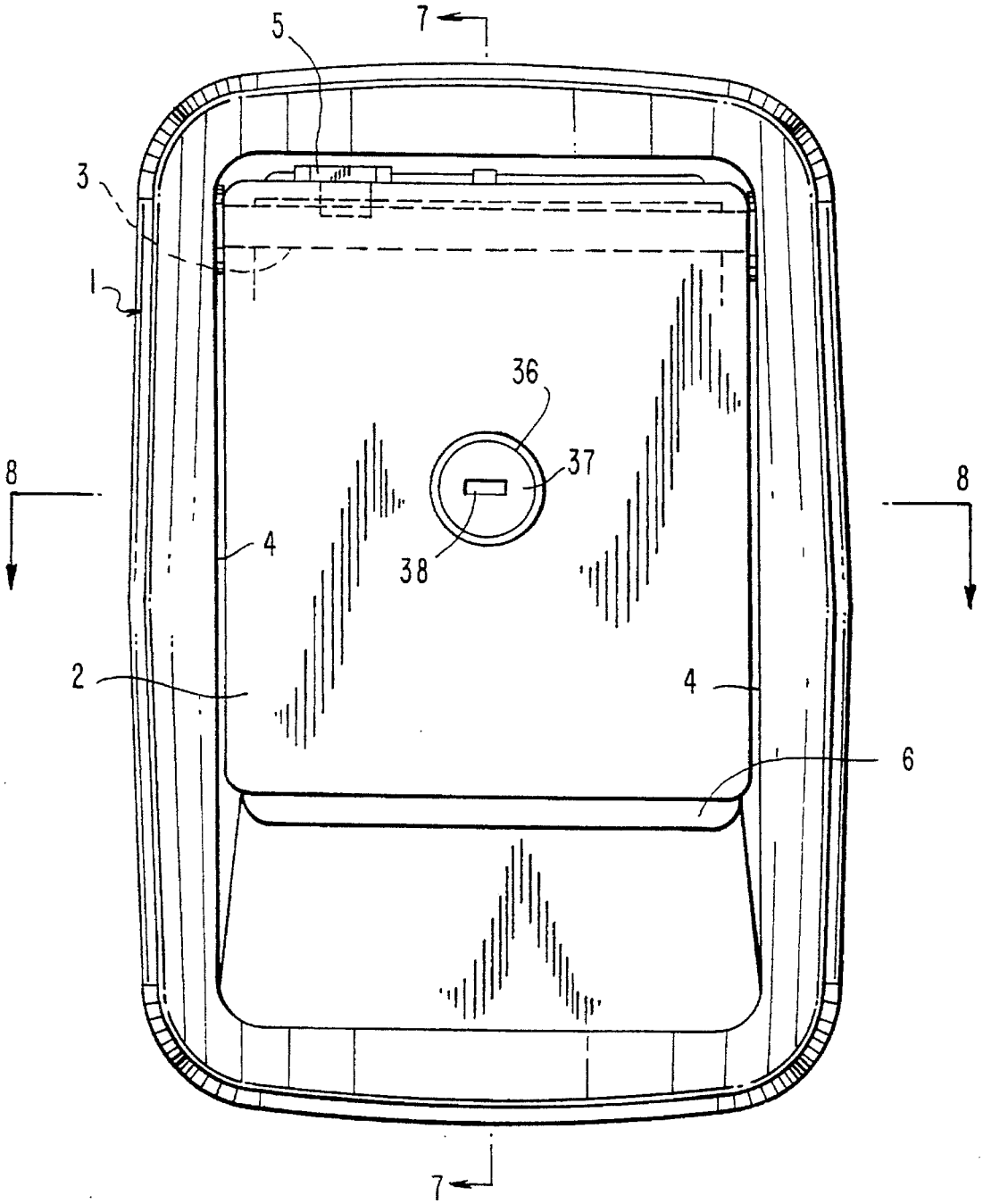
FIG. 1 is a front view of an embodiment of the embedded-type handle assembly of the present invention.
Figure 2:
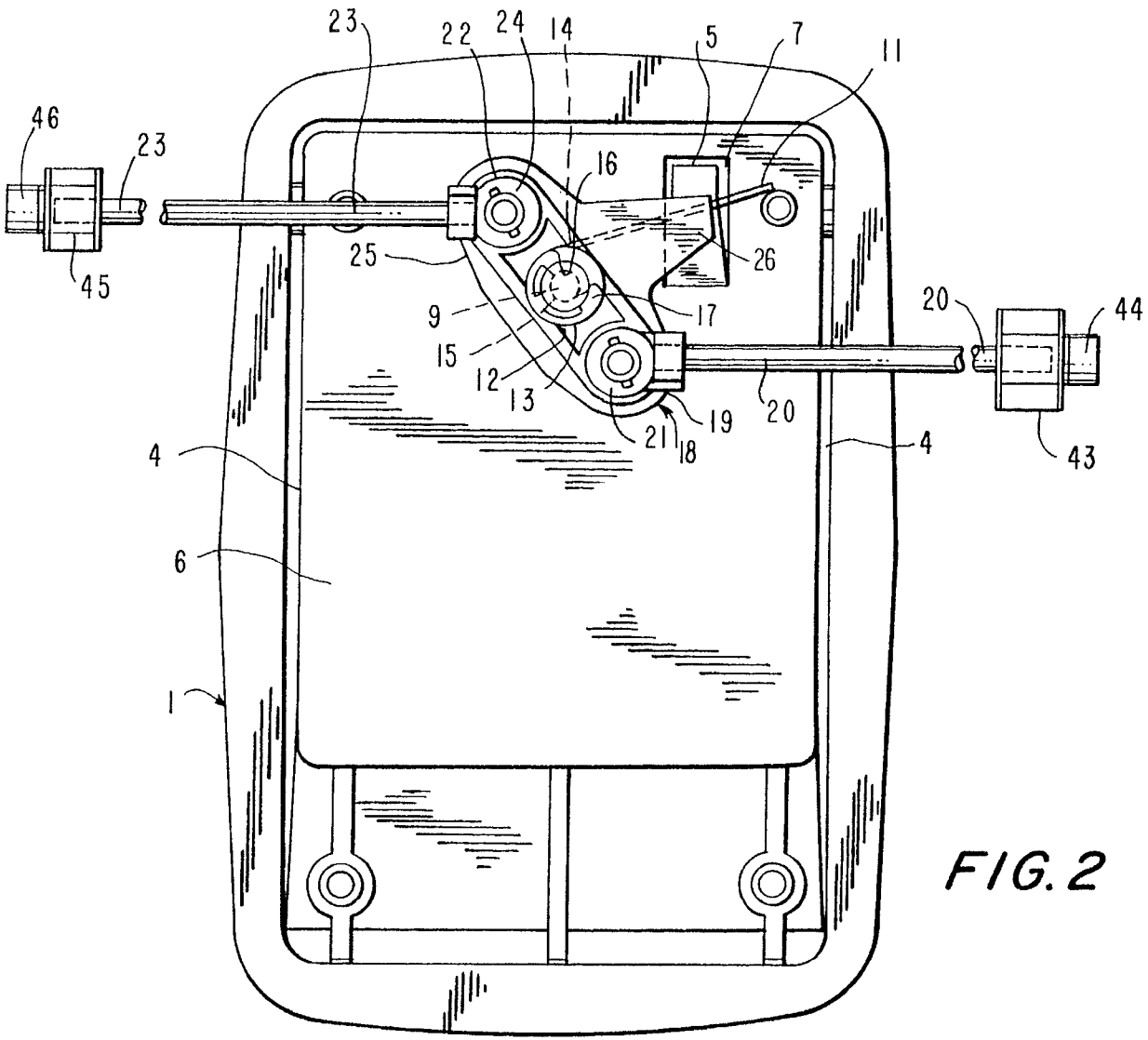
FIG. 2 is a rear view of the embedded-type handle assembly of the present invention shown in FIG. 1.
Figure 3:
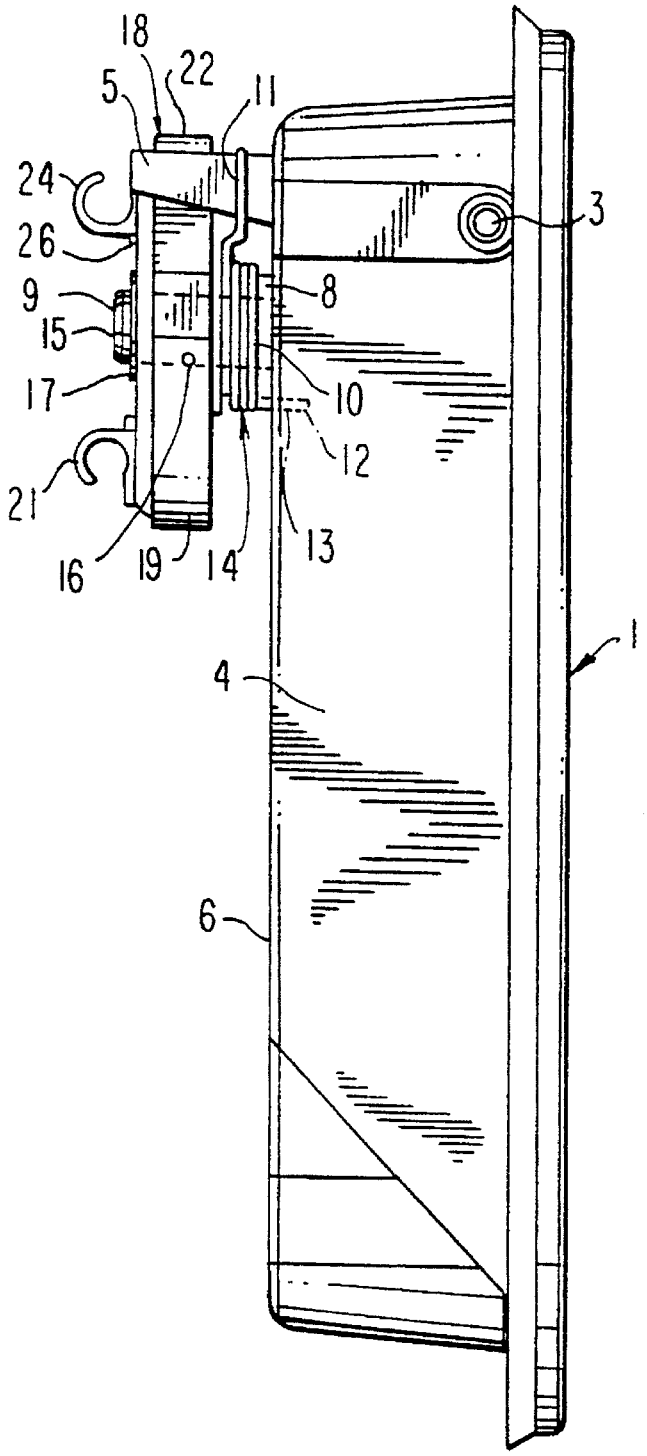
FIG. 3 is a left-side view of the embedded-type handle assembly of the present invention shown in FIG. 1.
Figure 4:
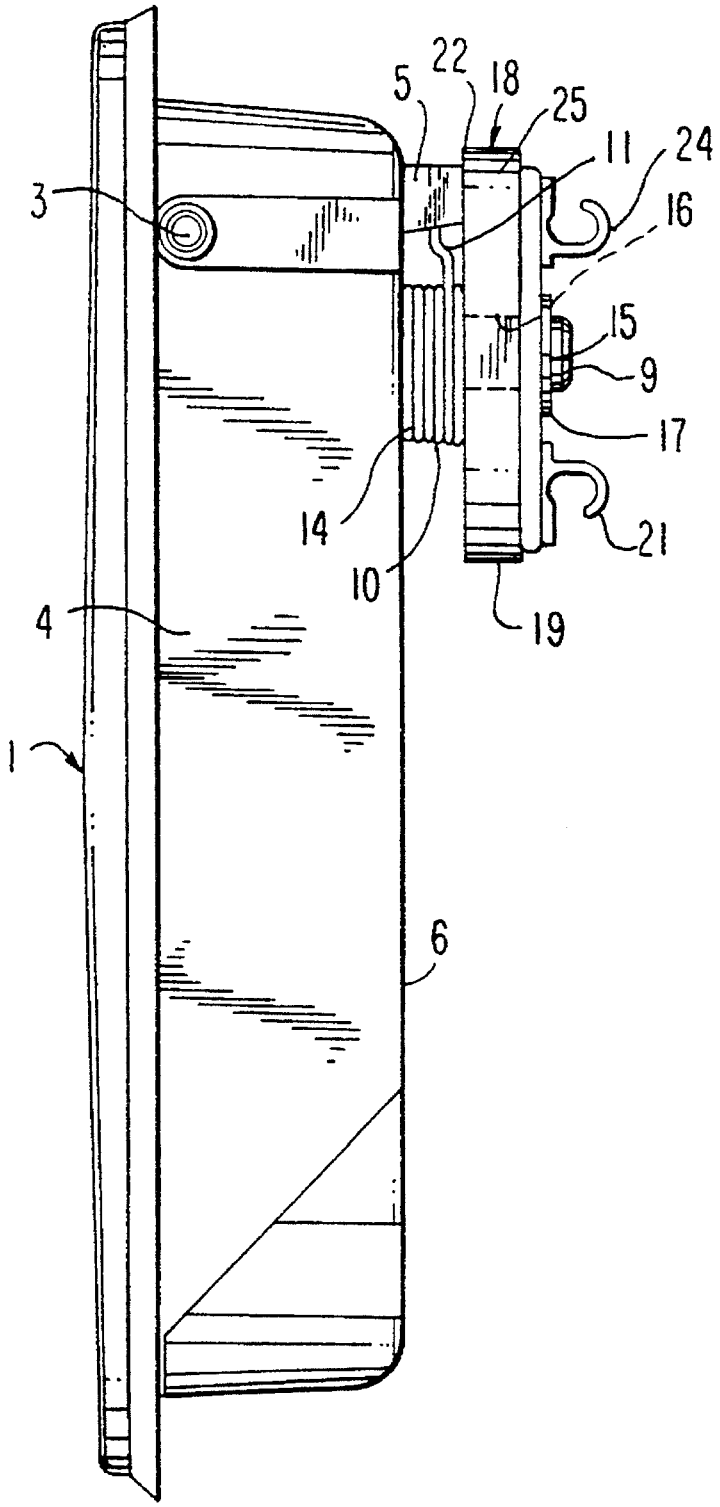
FIG. 4 is a right-side view of the embedded-type handle assembly of the present invention shown in FIG. 1.
Figure 5:
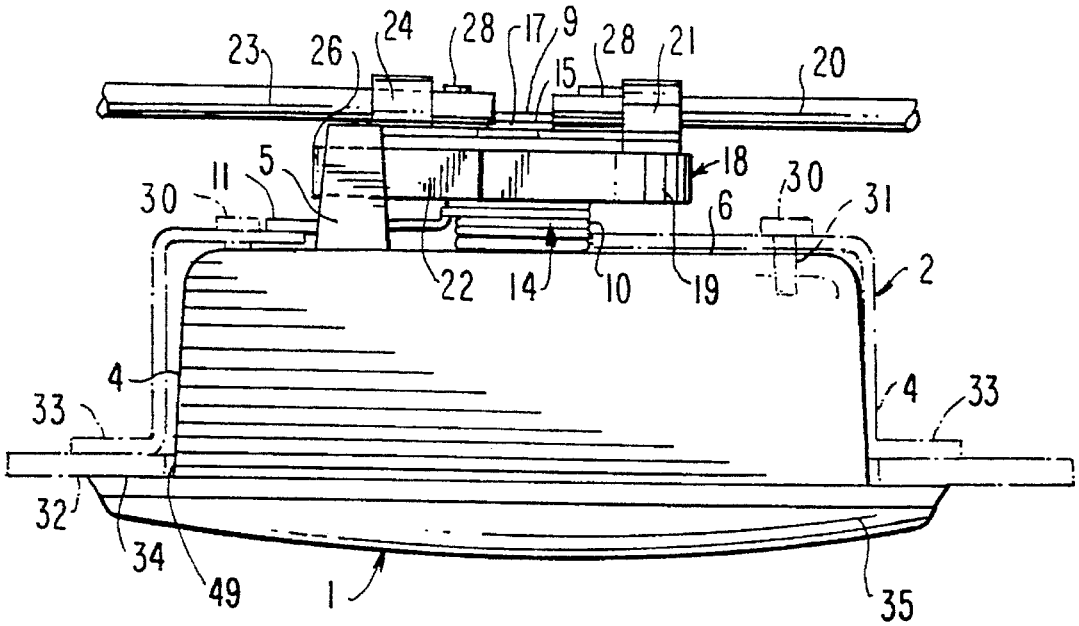
FIG. 5 is a plan view of the embedded-type handle assembly of the present invention shown in FIG. 1.
Figure 6:
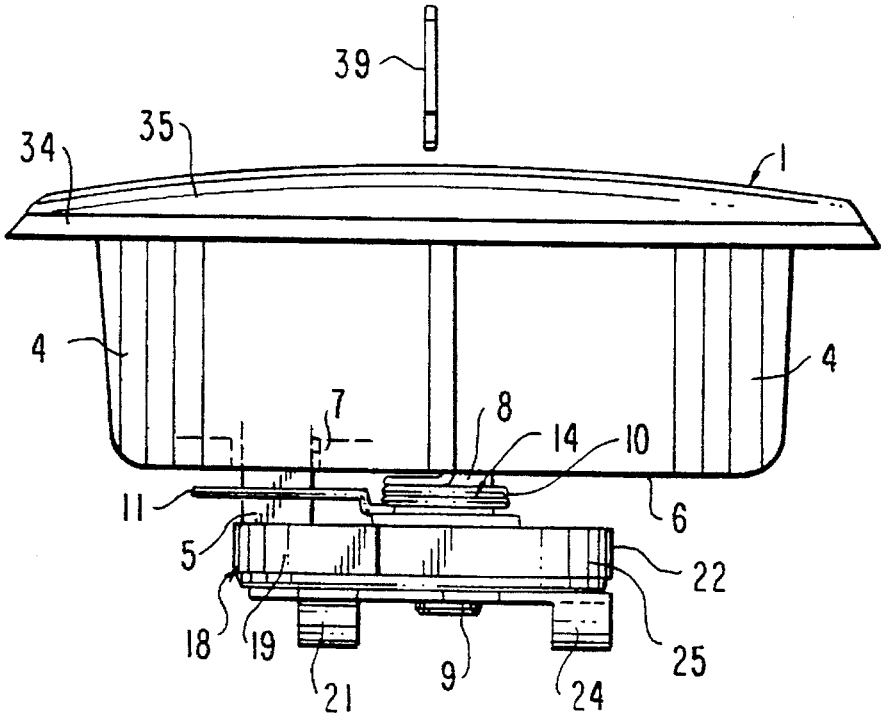
FIG. 6 is a bottom view of the embedded-type handle assembly of the present invention shown in FIG. 1.
Figure 7:
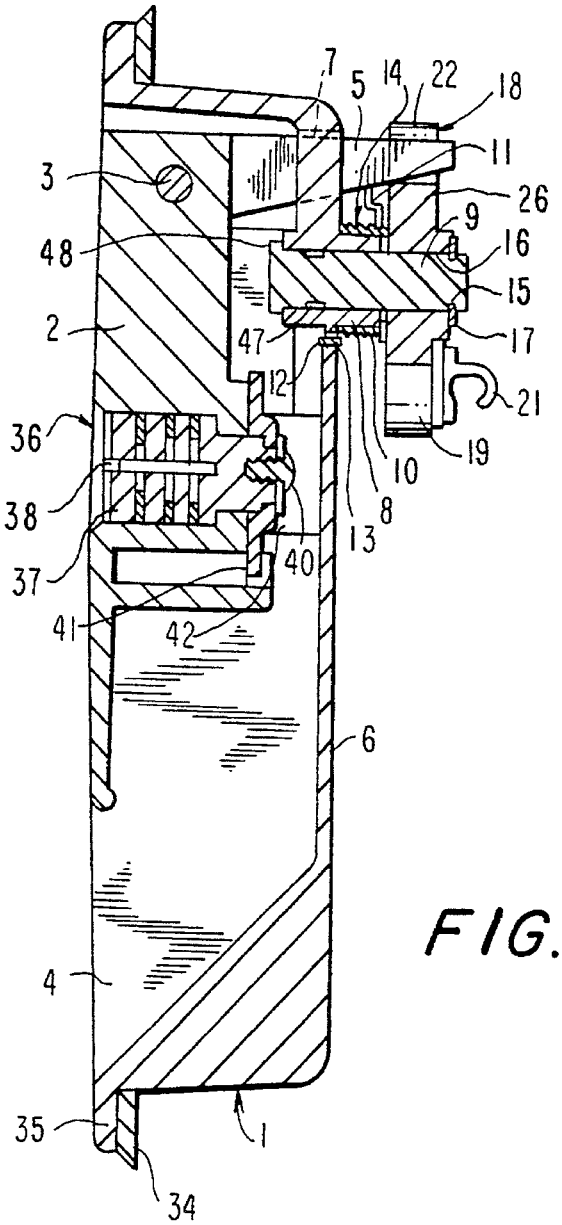
FIG. 7 is a longitudinal sectional view of the embedded-type handle assembly of the present invention, taken along the line 7—7 of FIG. 1.
Figure 8:
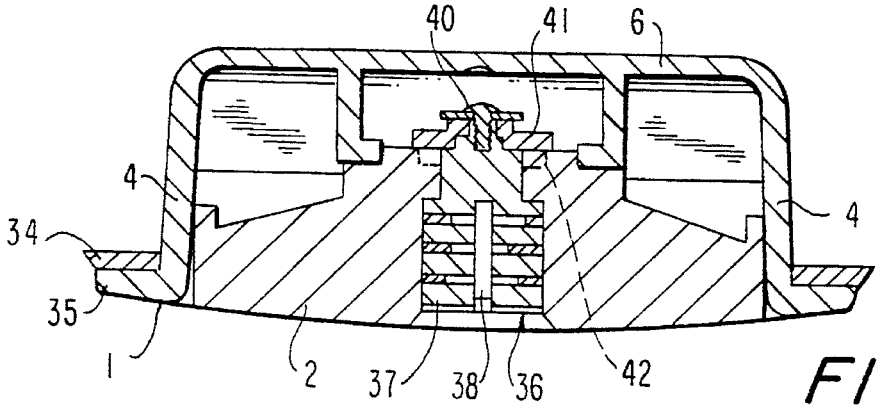
FIG. 8 is a cross-sectional view of the embedded-type handle assembly of the present invention, taken along the line 8—8 of FIG. 1.

Hereinbelow, the present invention will be described in detail with reference to the accompanying drawings and the reference numerals and characters.

In an embedded-type handle assembly of the present invention, a handle 2 is received in a casing 1 and has its base-end portion pivoted to side walls 4 of the casing 1 through a cross pivot 3. An operating-foot plate 5 projecting from a rear surface of the base-end portion of the handle 2 passes through a through-hole 7 of a bottom wall 6 of the casing 1 to project rearward. A cylindrical bearing portion 8 projecting outwardly from a rear surface of the bottom wall 6 of the casing 1 rotatably receives therein a shaft 9. The handle 2 is swingably biased toward its retracted or embedded position within the casing 1 by a coil type spring 14 mounted on the cylindrical bearing portion 8.

A link plate 18 is provided with a circular hole 16 through which the link plate 18 is mounted on a front-end portion of the shaft 9 in an insertion manner, and is prevented from dropping off the shaft front-end portion. A first lock bar 20 has its base-end portion connected with one end portion 19 of the link plate 18 through a pivot 27, while a second lock bar 23 has its base-end portion connected with the other end portion 22 of the link plate 18 through a pivot 28. The link plate 18 is provided with a follower surface 25 in a side surface of the other end portion 22. The follower surface 25 can be pushed by the operating-foot plate 5 of the handle 2. Further, the link plate 18 is provided with a follower projection 26 in a side surface of its intermediate portion. The follower projection 26 also can be pushed by the operating-foot plate 5 of the handle 2.

In operation, in the embodiment of the present invention shown in FIGS. 1 to 8, the first lock bar 20 and the second lock bar 23 are arranged horizontally. The operating-foot plate 5 of the handle 2 abuts against the follower projection 26 of the link plate 18. When the handle 2 is pulled out of the casing 1 to swing on the cross pivot 3, the operating-foot plate 5 of the handle 2 swingably moves in the through-hole 7 of the casing 1 to push a side surface of the follower projection 26. As a result, the link plate 18 swings on the shaft 9 so that the horizontally-arranged lock bars 20, 23 are pulled toward the casing 1.

Figure 9:
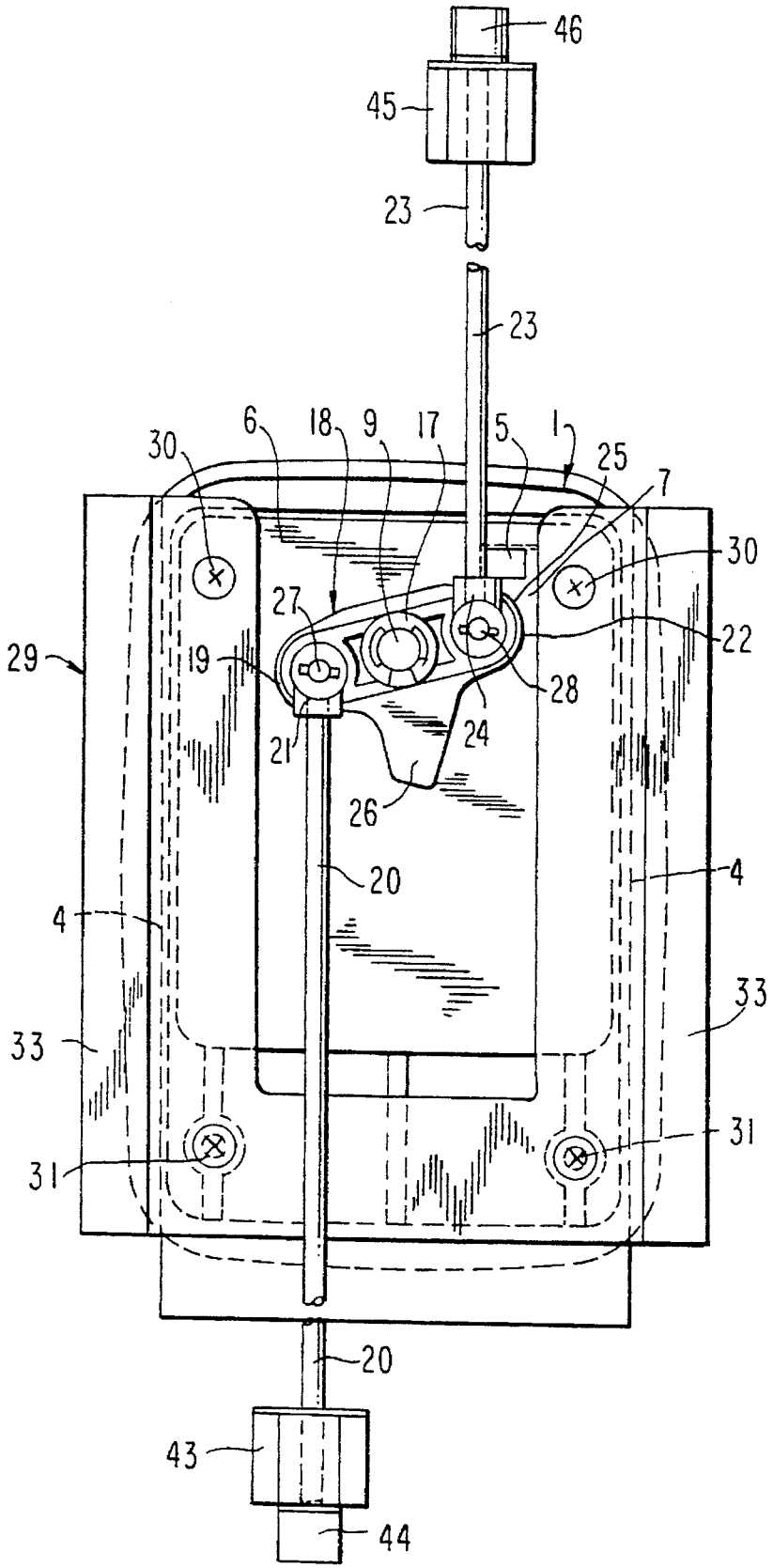
FIG. 9 is a rear view of another embodiment of the embedded-type handle assembly of the present invention.

In another embodiment of the present invention shown in FIG. 9, the lock bars 20, 23 are vertically arranged with respect to the casing 1. The handle 2 has its operating-foot plate 5 abutted against the follower surface 25 of the link plate 18. When the handle 2 is pulled out of the casing 1 to swing on the cross pivot 3, the operating-foot plate 5 swingably moves in the through-hole 7 to push the follower surface 25 so that the link plate 18 swings on the shaft 9, whereby the lock bars 20, 23 are pulled toward the casing 1.

As described above, the lock bars 20, 23 may be arranged either horizontally (as shown in FIGS. 2 to 8) or vertically (as shown in FIG. 9). The user may select either arrangement of the lock bars 20, 23 by rotating the link plate 18 (which has been mounted on the shaft 9 in an insertion manner) through a predetermined angle relative to the casing 1, and then mounting the lock bars 20 and 23 on the corresponding end portions 19 and 22 of the link plate 18, respectively.

In the embodiments of the present invention, the cylindrical bearing portion 8 of the casing 1 is located in a position on a vertical center line of the bottom wall 6 of the casing 1. An O-ring 47 is interposed between the shaft 9 and the cylindrical bearing portion 8 of the casing 1. The shaft 9 is provided with a flange portion 48 in its base-end portion. The flange portion 48 abuts against a front surface of the cylindrical bearing portion 8 of the casing 1. The return spring 14 of the handle 2 is constructed of a coil spring which has: its coiled portion 10 mounted on the cylindrical bearing portion 8 of the casing 1 in an insertion manner; its one linear end portion 11 abutted against the operating-foot plate 5 of the handle 2; and its the other end portion 12 inserted in a receiving hole 13 of the bottom wall 6 of the casing 1.

An E-ring 17 is mounted in an annular groove 15 of the front-end portion of the shaft 9 in an insertion manner. Consequently, the flange portion 48 of the shaft 9 and the E-ring 17 mounted thereon cooperate with each other so as to prevent both the shaft 9 and the link plate 18 from dropping out of the handle assembly. The base-end portion of the first lock bar 20 is fixedly mounted on a mounting-aid member 21 in an insertion manner. The mounting-aid member 21 is connected with the one end portion 19 of the link plate 18 through a pivot 27. The other end portion 22 of the link plate 18 is connected with another mounting-aid member 24 on which the base-end portion of the second lock bar 23 is fixedly mounted in an insertion manner.

A latch element 44 is connected with the front-end portion of the first lock bar 20, and inserted in a guide casing 43 which is fixedly mounted on a rear surface of a door 32. On the other hand, another latch element 46 is connected with the front-end portion of the second lock bar 23, and inserted in another guide casing 45 which is fixedly mounted on the rear surface of the door 32. These latch elements 44, 46 engage with socket members (not shown) of a stationary frame element (not shown) to lock the door 32 to the stationary frame element.

The casing 1 is mounted in a mounting hole 49 of the door 32 from its front side in an insertion manner, and is provided with a front-end flange portion 35. A packing 34 is interposed between the flange portion 35 of the casing 1 and the door 32. A mounting seat plate 29 is provided over the casing 1 from the casing rear side. The seat plate 29 has its front-end bent plate portion 33 abutted against the rear surface of the door 32, in which condition a screw 30 is threadably engaged with each of threaded holes 31 of the bottom wall 6 of the casing 1 so that the casing 1 is fixedly mounted on the door 32.

A lock unit 36 is fixedly mounted in a central portion of the handle 2. In the lock unit 36, a lock plate 41 is fixed to a front-end portion of a rotor 37 by a screw 40, and engages with locking socket portion 42 of the casing 1 to lock the handle 2 to the casing 1. When a key 39 is inserted into a key hole 38 of the rotor 37 and rotated in a predetermined direction, the handle 2 is unlocked from the locking socket portion 42 of the casing 1.

In the embedded-type handle assembly of the present invention having the above construction, the shaft 9 is rotatably inserted in the cylindrical bearing portion 8 of the bottom wall 6 of the casing 1 in an insertion manner. On the other hand, the link plate 18: is mounted on the shaft 9 through its circular hole 16; has its one end portion 19 connected with the first lock bar 20 through the pivot 27 and its the other end portion 22 connected with the second lock bar 23 through the pivot 28; and, is provided with the follower surface 25 (which is pushed by the operating-foot plate 5 of the handle 2) in a side follower projection 26 (which is pushed by the operating-foot plate 5 of the handle 2) in its intermediate portion's side surface. Consequently, it is possible for the user to select either arrangement of the lock bars 20, 23 by simply rotating the link plate 18 on the shaft 9 relative to the casing 1 so as to arrange the lock bars 20, 23 either horizontally or vertically.

Since the embedded-type handle assembly of the present invention can be used in either arrangement of the lock bars 20, 23 described above, it is possible to cut manufacturing costs and save storage space for the products.

What is claimed is:

1. An embedded-type handle assembly, comprising:

a casing (1) having side walls (4) and a bottom wall (6);

a handle (2) having a base-end portion which is pivoted to the side walls (4) of said casing (1) through a cross pivot (3) so as to be received in said casing (1), said handle (2) being provided with an operating-foot plate (5) in a rear surface of said handle base-end portion, which plate (5) projects from said rear surface to pass through a through-hole (7) of the bottom wall (6) of said casing (1), said bottom wall (6) having a cylindrical bearing portion (8) projected outwardly from a rear surface of the bottom wall (6);

a shaft (9) rotatably inserted in said cylindrical bearing portion (8) of said casing (1);

a spring (14) encircling said cylindrical bearing portion (8) and arranged for biasing said handle (2) toward its embedded position within said casing (1);

a link plate (18) provided with a circular hole (16) through which said link plate (18) is mounted on a front-end portion of said shaft (9) in an insertion manner, said link plate (18) being prevented from dropping off of said shaft (9);

a first lock bar (20) having its base-end portion connected with one end portion (19) of said link plate (18) through a pivot (27);

a second lock bar (23) having its base-end portion connected with the other end portion (22) of said link plate (18) through a pivot (28); and said link plate (18) being provided with a follower surface (25) in a side surface of the other end portion (22), so that said follower surface (25) can be pushed by said operating-foot plate (5) of said handle (2) to rotate said link plate (18) and move said first and second lock bars (20, 23).

2. The handle assembly of claim 1, wherein each said lock bar (20, 23) has a front end portion which extends through a guide casing (43, 45) positioned for fixedly mounting on a door (32), and is attached to a latch member (44, 46).

3. The handle assembly of claim 1, wherein said casing (1) is attached to a seat plate (29) and is mounted in a mounting hole (49) of a door (32), said casing (1) includes a front flange portion (35), with a packing (34) being interposed between said flange portion (35) and the door (32).

4. The handle assembly of claim 1, including a lock unit (36) fixedly mounted in a central portion of the handle (2), said locking unit (36) including a lock plate (41) which engages a locking portion (42) of said casing (1).

5. The handle assembly of claim 1, wherein said link plate (18) is also provided with a follower projection (26) in a side surface of its intermediate portion, so that whenever said follower projection (26) is pushed by said operating-foot plate (5) of said handle (2), said link plate (18) is rotated with said shaft (9) to move said lock bars (20, 23).

6. An embedded-type handle assembly, comprising:

a casing (1) having side walls (4) and a bottom wall (6);

a handle (2) having a base-end portion which is pivoted to the side walls (4) of said casing (1) through a cross pivot (3) so as to be received in said casing (1), said handle (2) being provided with an operating-foot plate (5) in a rear surface of said handle base-end portion, which plate (5) projects from said rear surface to pass through a through-hole (7) of the bottom wall (6) of said casing (1), said bottom wall (6) having a cylindrical bearing portion (8) projected outwardly from a rear surface of the bottom wall (6);

a shaft (9) rotatably inserted in said cylindrical bearing portion (8) of said casing (1);

a spring (14) encircling said cylindrical bearing portion (8) and arranged for biasing said handle (2) toward its embedded position within said casing (1);

a link plate (18) provided with a circular hole (16) through which said link plate (18) is mounted on a front-end portion of said shaft (9) in an insertion manner, said link plate (18) being prevented from dropping off of said shaft (9);

a first lock bar (20) having its base-end portion connected with one end portion (19) of said link plate (18) through a pivot (27);

a second lock bar (23) having its base-end portion connected with the other end portion (22) of said link plate (18) through a pivot (28);

said link plate (18) being provided with a follower surface (25) in a side surface of the other end portion (22), and is also provided with a follower projection (26) in an intermediate portion of the link plate, so that either said follower surface (25) or the follower projection (26) can be pushed by said operating-foot plate (5) of said handle (2) to rotate said link plate (18) and move said first and second lock bars (20, 23); wherein each said lock bar (20, 23) has a front end portion which extends through a guide casing (43,45) positioned for fixedly mounting on a door (32), and is attached to a latch member (44,46); and a lock unit (36) fixedly mounted in a central portion of the handle (2), said lock unit (36) including a lock plate (41) which engages a locking portion (42) of said casing (1).

* * * * *